US006966756B2

(12) United States Patent
McGrath et al.

(10) Patent No.: US 6,966,756 B2
(45) Date of Patent: Nov. 22, 2005

(54) TURBINE BUCKET COOLING PASSAGES AND INTERNAL CORE FOR PRODUCING THE PASSAGES

(75) Inventors: Edward Lee McGrath, Easley, SC (US); Benjamin Arnette Lagrange, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/753,341

(22) Filed: Jan. 9, 2004

(65) Prior Publication Data

US 2005/0152785 A1 Jul. 14, 2005

(51) Int. Cl.[7] ..... F01D 5/18
(52) U.S. Cl. ..... 416/97 R; 416/96 R
(58) Field of Search ..... 415/115, 116; 416/96 R, 416/96 A, 97 R

(56) References Cited

U.S. PATENT DOCUMENTS

| | | | | |
|---|---|---|---|---|
| 4,017,210 | A | 4/1977 | Darrow | |
| 4,023,249 | A | 5/1977 | Darrow et al. | |
| 4,023,251 | A | 5/1977 | Darrow | |
| 4,040,159 | A | 8/1977 | Darrow et al. | |
| 4,183,456 | A | 1/1980 | Schilling et al. | |
| 4,185,369 | A | 1/1980 | Darrow et al. | |
| 4,497,613 | A | 2/1985 | Carreno | |
| 5,599,166 | A * | 2/1997 | Deptowicz et al. | 416/97 R |
| 5,779,447 | A * | 7/1998 | Tomita et al. | 416/97 R |
| 5,947,181 | A | 9/1999 | Davis | |
| 5,950,705 | A | 9/1999 | Huang | |
| 6,186,741 | B1 * | 2/2001 | Webb et al. | 416/96 R |
| 6,234,753 | B1 * | 5/2001 | Lee | 416/97 R |
| 6,390,774 | B1 | 5/2002 | Lewis et al. | |
| 6,464,462 | B2 | 10/2002 | Stathopoulos et al. | |
| 6,467,534 | B1 | 10/2002 | Klug et al. | |
| 6,637,500 | B2 * | 10/2003 | Shah et al. | 164/369 |
| 6,672,836 | B2 * | 1/2004 | Merry | 416/97 R |
| 2004/0202542 | A1 * | 10/2004 | Cunha et al. | 416/97 R |

* cited by examiner

*Primary Examiner*—Christopher Verdier
(74) *Attorney, Agent, or Firm*—Nixon & Vanderhye P.C.

(57) ABSTRACT

A turbine bucket comprising an airfoil portion, a shank portion and a dovetail mounting portion; an internal cooling circuit including inlet passages in the shank portion and the dovetail mounting portion connected to a cooling circuit in the airfoil portion, the inlet passages including a primary inlet passage on one side of a radial centerline of the bucket, and a secondary inlet cavity on an opposite side of the radial centerline; and a purge passage connecting the secondary inlet passage to the primary inlet passage.

13 Claims, 5 Drawing Sheets

TURBINE BUCKET COOLING PASSAGES AND INTERNAL CORE FOR PRODUCING THE PASSAGES

BACKGROUND OF THE INVENTION

This invention relates to the manufacture of gas turbine blades or buckets and specifically, to an internal core arrangement utilized in the casting of turbine buckets, and to a bucket having cooling inlet passages formed by the core.

Single five-pass aft-flowing serpentine circuits have been proven to be an efficient and cost effective means of air cooling the shank and airfoil portions of a gas turbine bucket. This design represented a step forward in turbine cooling technology since air cooled stage 2 buckets have historically been cooled by stem-drilled radial holes. Since the source of the coolant air for the serpentine circuit is at the bottom or radially inner end of the dovetail mounting portion of the bucket, a passage is provided for feeding air through the shank portion of the bucket. In the prior arrangement, the cast inlet passage to the serpentine circuit is large and fills most of the shank in order to minimize the amount of solid metal in the shank. Weight minimization is important since extra weight increases the centrifugal loading on the rotor wheel. The problem with this prior design, however, is the lack of a continuous rib along the entire length of the bucket including the shank and airfoil portions, which is an important mechanical design criteria for bucket stiffness.

Another core arrangement, is disclosed in copending application Ser. No. 10/604,220, filed Jul. 1, 2003. This so-called "pant-leg" core is used in certain stem cooled buckets but like the core discussed above, it does not allow for a continuous center rib from the dovetail mounting portion to the bucket tip.

BRIEF DESCRIPTION OF THE INVENTION

This invention relates to a new bucket shank internal core feature that has been developed for the shank portion of a turbine bucket with a single multi-pass serpentine cooling circuit in the airfoil portion of the bucket. Two separate core sections are provided in the shank area of the bucket. The core section of particular interest here is shaped to form a substantially inverted horseshoe-shape that is purged through an elliptical-shaped core tie passage to the primary inlet passage formed by the other adjacent core section. This core arrangement produces a bucket having advantages such as weight reduction as well as thermal and geometric symmetry in the shank, permitting the casting of a full length center rib from the shank portion to the tip of the airfoil portion.

More specifically, the shank portion of the bucket is formed utilizing a pair of internal core sections located on either side of a radial centerline through the shank and airfoil portions of the bucket. To one side of the centerline, a first inlet core section is arranged to produce the primary cooling supply passage to the serpentine cooling circuit. Specifically, the core section is shaped to provide two passages that merge at the inlet to the serpentine circuit. On the other side of the radial centerline, an inverted horseshoe-shaped core section is arranged to produce a cavity of generally similar shape to the primary inlet passage. A cast-in elliptical core tie feature is incorporated whereby the horseshoe-shaped cavity will be fluidly connected to the primary inlet passage by a relatively small passage. The elliptical core tie thus serves two purposes. One is to provide additional core stability during casting. The second purpose is to form a purge passage that will purge the cooling air in the horseshoe-shaped cavity. Specifically, in use, the cooling air enters the horseshoe-shaped cavity from the bottom of the dovetail portion of the bucket and is metered by the elliptical core tie passage into the primary inlet passage. Without the purge flow, the horseshoe cavity would be a dead-end cavity filled with hot stagnant air. This stagnant hot air would result in a thermal disparity in the shank, i.e., the forward half of the shank with the serpentine inlet would be cool and the aft half with the dead-end horseshoe cavity would be hot. Such a thermal mismatch would produce undesired thermally induced stresses in the shank.

Ball-braze chutes at the top of both core sections support the sections during casting. After casting, the chutes are plugged because, otherwise, the flow in the serpentine circuit would be disturbed if the coolant air were allowed to enter the serpentine circuit at these locations.

The core tie passage is elliptically shaped in cross-section in order to reduce its stress concentration factor, since it passes through the radially oriented center rib which is carrying a significant radial load. The shape of the elliptical core tie is engineered to balance the stress concentration factor in the effective flow area, and to set the amount of purge flow. The purge flow must be metered such that it has minimal impact on the flow within the inlet to the serpentine circuit.

Accordingly, in its broader aspects, the present invention relates to a turbine bucket comprising an airfoil portion, a shank portion and a dovetail mounting portion; an internal cooling circuit including inlet passages in the shank portion and the dovetail mounting portion connected to a cooling circuit in the airfoil portion, the inlet passages including a primary inlet passage on one side of a radial centerline of the bucket, and a secondary inlet cavity on an opposite side of the radial centerline; and a purge passage connecting the secondary inlet passage to the primary inlet passage.

In another aspect, the invention relates to a turbine bucket comprising an airfoil portion; a shank portion; a mounting portion; and an internal cooling circuit that includes a serpentine cooling passage in the airfoil portion and an inlet passage configuration in the shank and the mounting portion; the inlet passage configuration comprising a primary inlet passage adjacent a leading edge side of the bucket and a secondary inlet passage adjacent a trailing edge side of the bucket, and wherein a purge passage of elliptical cross-sectional shape connects the primary inlet passage and the secondary inlet passage to thereby purge cooling air from the secondary inlet passage.

The invention will now be described in detail in connection with the drawings identified below.

DETAILED DESCRIPTION OF THE INVENTION

Figure 1:
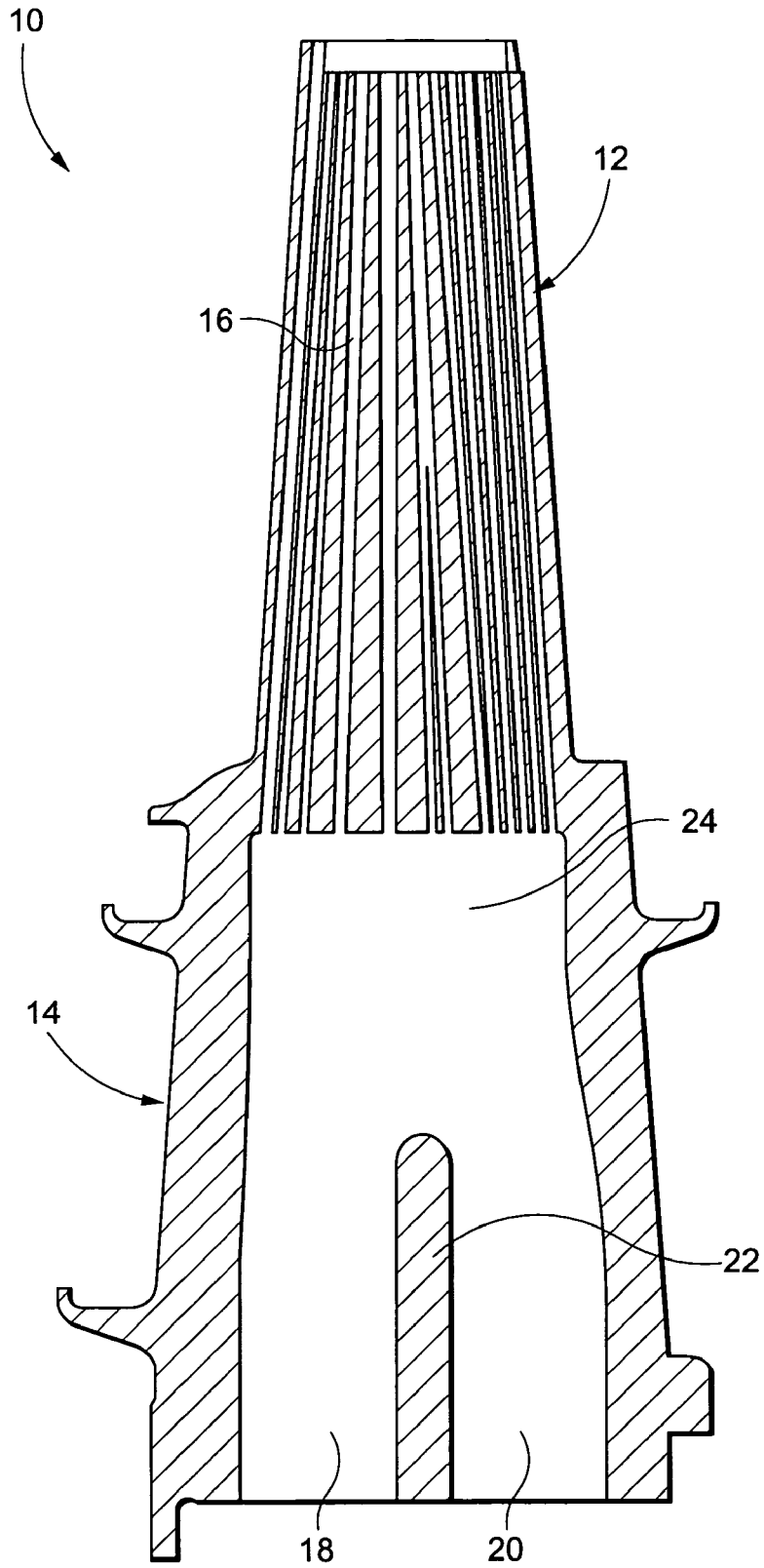
Fig. 1 (PRIOR ART)
FIG. 1 is a cross-sectional view of a known turbine bucket.

With reference to FIG. 1, a known stage- 1 turbine bucket 10 is shown that includes an airfoil portion 12, a shank portion 14 and a plurality of radially extending, stem-drilled cooling passages 16 that are supplied with cooling air by means of side-by-side inlet passages 18 and 20 that are separated in a radially inner portion of the shank by a center rib 22. The inlet passages 18 and 20 merge in a common passage area 24, and are formed in the manufacturing process by a "pant-leg" core section of similar shape. This arrangement is characteristic of cores that are cast to certain stem-cooled buckets and certain gas turbine machines manufactured by the assignee.

Figure 2:
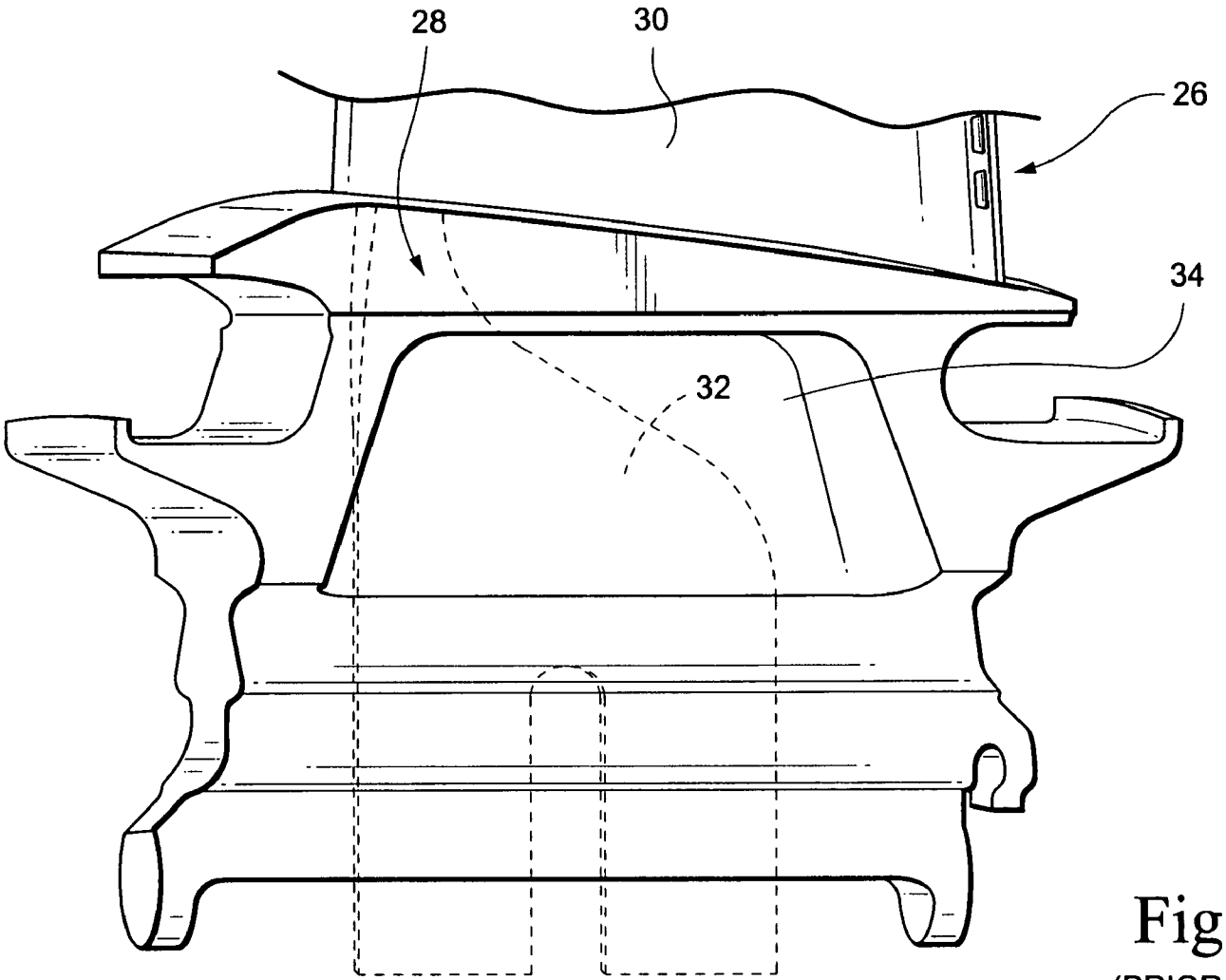
Fig. 2 (PRIOR ART)
FIG. 2 is a partial elevation of a prior turbine bucket construction, indicating cooling inlet passages in phantom.

FIG. 2 illustrates another known cooling inlet arrangement for a stage 2 bucket 26 where internal cooling is achieved by means of a five pass aft-flowing serpentine circuit, partially indicated at 28 and extending radially outwardly through the airfoil portion 30. Note that the cast inlet 32 to the serpentine passage, is relatively large and fills most of the shank portion 34 in order to minimize the amount of solid metal in the shank. With this internal core design, however, no continuous rib can be provided extending along the entire length of the bucket, from the shank 34 and through the airfoil portion 30 to the bucket tip (not shown).

Figure 3:
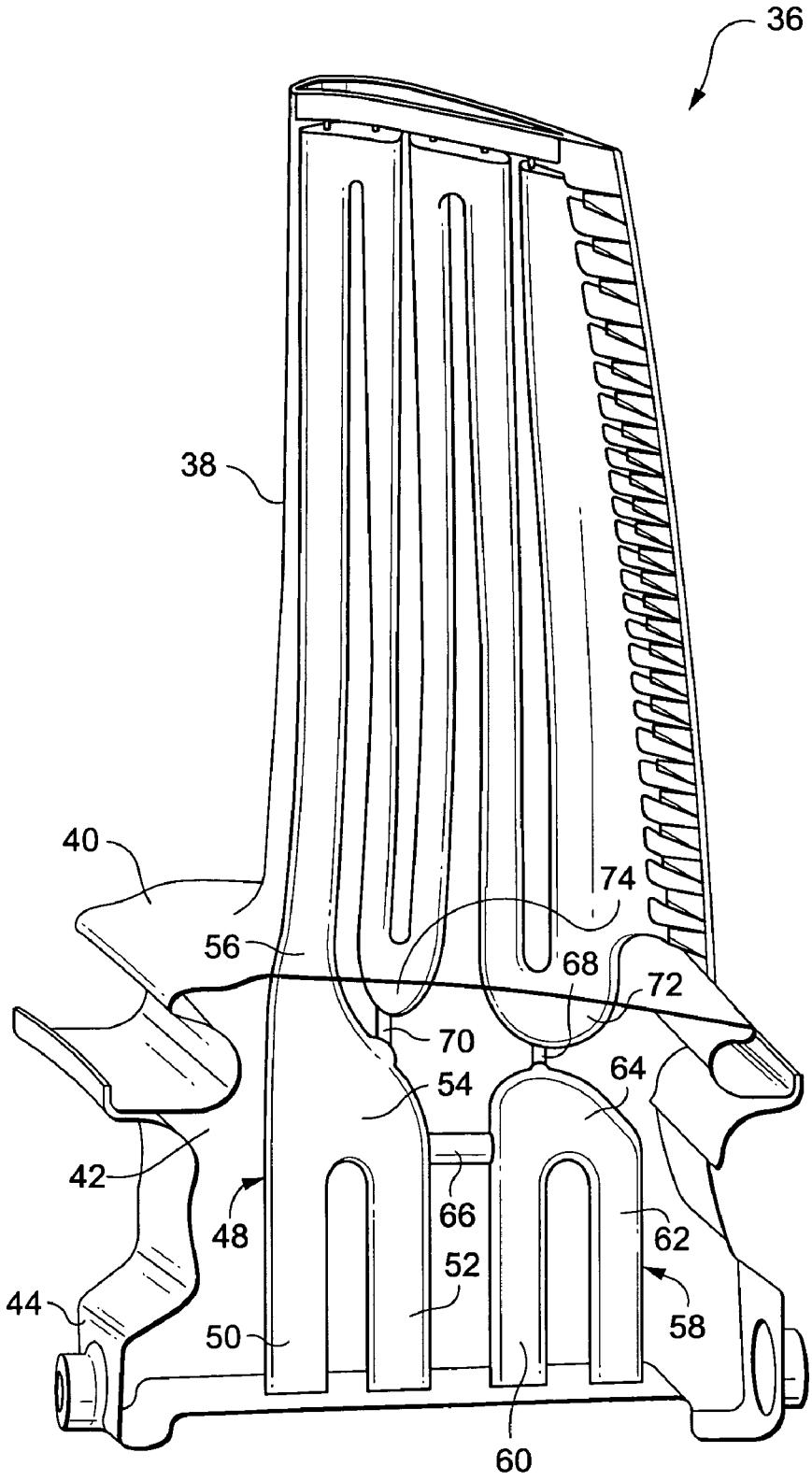
FIG. 3 is a perspective view of a turbine bucket casting in accordance with an exemplary embodiment of this invention, but shown in transparent form, with internal casting core sections in place.

FIG. 3 illustrates a stage 2 turbine bucket casting 36 in accordance with an exemplary embodiment of this invention and includes an airfoil portion 38, platform 40, shank portion 42 and dovetail portion 44. The bucket is shown in substantially transparent form, however, with the solid metal portions removed and the core sections used in casting shown in place for ease of understanding.

As will be appreciated from FIG. 3, the internal core structure in the shank and dovetail portions 42, 44 is divided into two sections. A first core section 48 includes side-by-side passage portions 50 and 52 that join together at a radially outer end of the section in a common area 54. This core section is connected to the internal serpentine core section 56. On the other side of the bucket radial centerline, a second core section 58 is arranged in side-by-side relationship with the first core section 48. The second core section 58 has a generally inverted horseshoe-shape including side-by-side passage portions 60, 62 joining together at 64. A cast-in elliptical core tie 66 runs between the "base" (or radially outer end) 64 of the horseshoe-shaped section 58 and the common area 54 of the first core section 48.

The cast-in elliptical core tie 66 provides additional core stability during casting. In addition, it creates an elliptical purge passage that allows a small amount of cooling air to purge the horseshoe-shaped cavity produced by the core section 58 as described further herein. The elliptical core tie 66 is elliptical in cross sectional shape to reduce its stress concentration factor since it passes through the center rib that carries a significant radial load. Preferably, the major axis is 0.2 inch (in the radial direction) and the minor axis is 0.070 inch (in the circumferential direction). These dimensions may change depending on factors such as air flow required through the passage created by the tie, stress concentration, and core stability during casting. The shape of the elliptical core tie is also engineered to balance the stress concentration factor and the effect of flow area (thus setting the amount of purge flow). The purge flow must be metered so it has minimal impact on the flow in the serpentine circuit.

Figure 4:
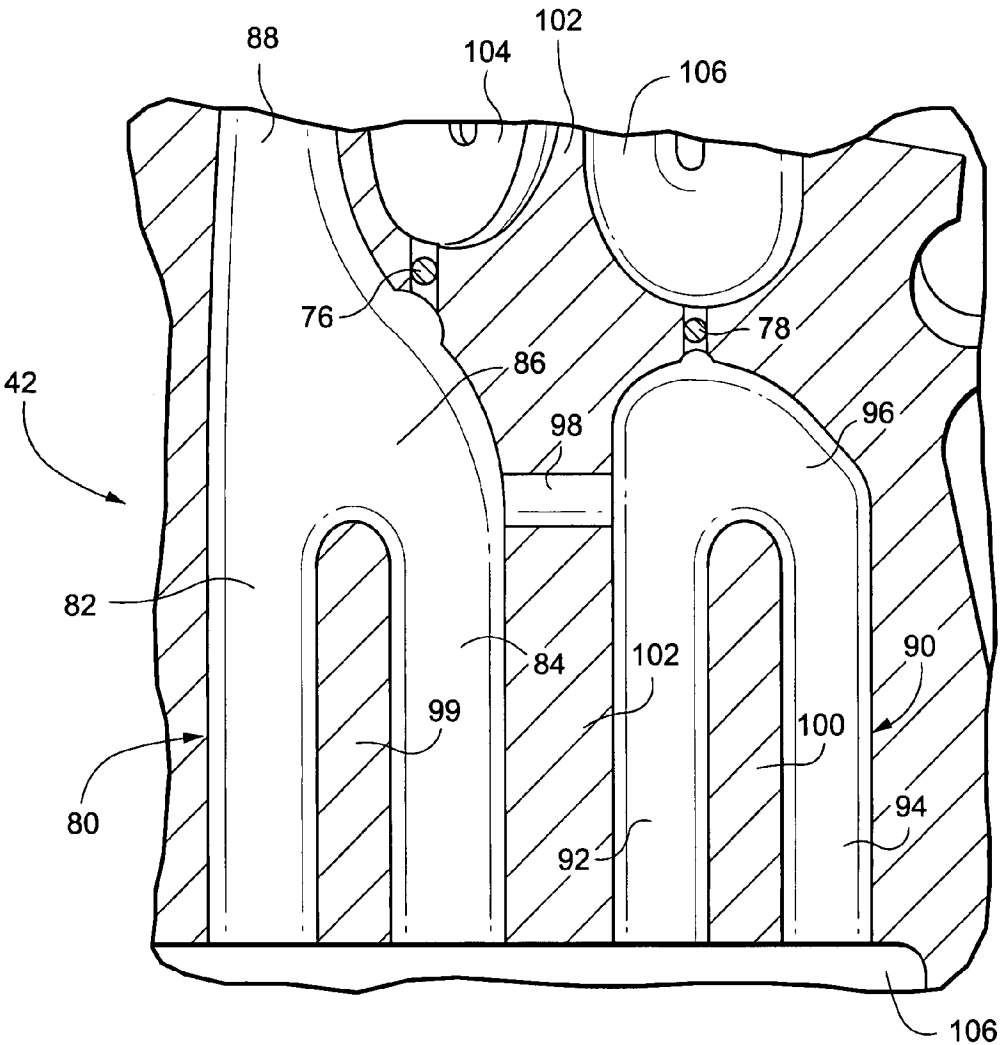
FIG. 4 is a partial section of the bucket shown in FIG. 3 showing internal cooling passages in the shank section of the bucket.
Figure 5:
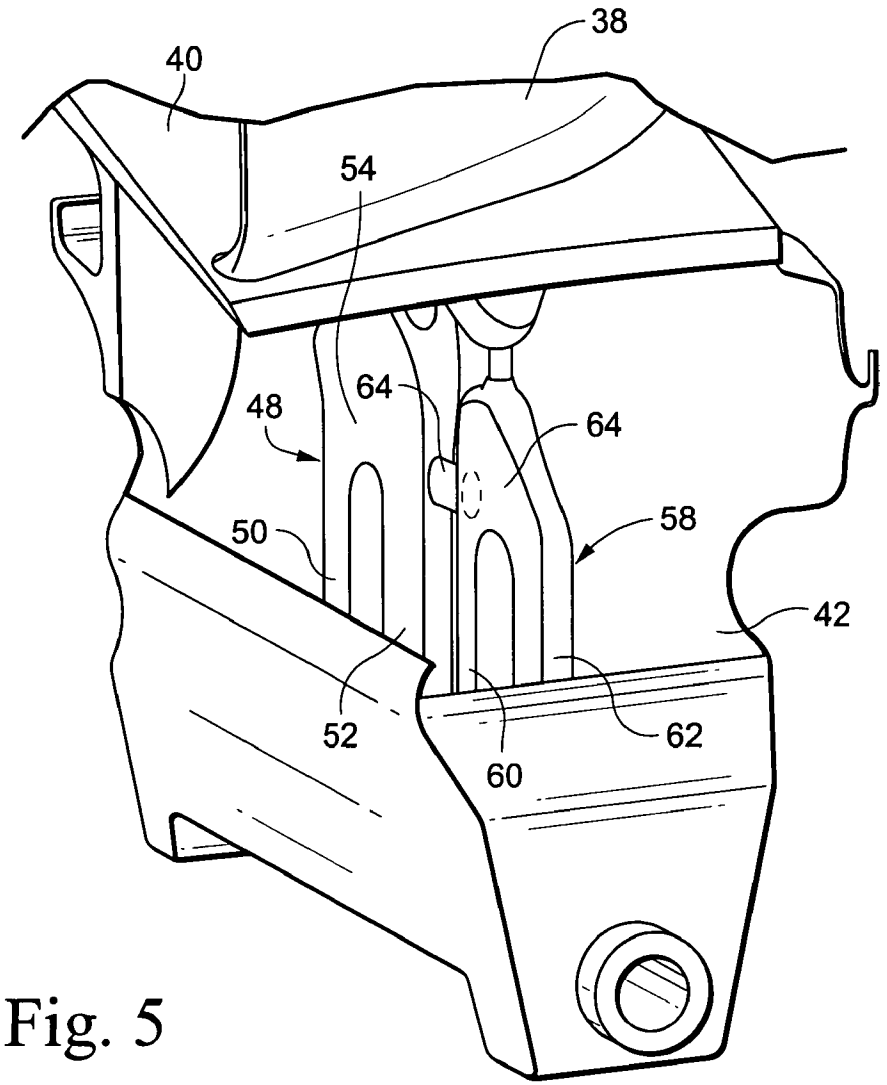
FIG. 5 is a partial perspective view, taken from the right side of the bucket shown in FIG. 3.

So-called "ball braze chutes" 70 and 68 connect the respective core sections 48 and 58 to respective serpentine cooling circuit core portions 72, 74. These temporary core features serve to support the core sections 48 and 58 during casting. After casting, these "chutes" will be plugged by brazing steel balls 76, 78 within the passages formed by the chutes 68, 70 (FIG. 4). Otherwise, the flow in the serpentine circuit would be disturbed if the coolant air was allowed to enter the circuit at these locations.

Turning now to FIG. 4, the shank portion 42 of bucket 36 is shown, after casting and removal of the core sections 48, 58. Thus, the first core section 48 produces primary inlet passage 80 including cooling passage portions 82, 84 that merge in a common area 86 that fluidly connects to the serpentine cooling circuit or passage 88. The second or horseshoe-shaped core section 58 produces a generally horseshoe-shaped cavity 90 (or secondary inlet passage) including inlet portions 92, 94 that merge in a common base area 96 at the radially outer end of the cavity. The elliptical core tie 66 produces an elliptical purge passage 98 that directly connects the common area 96 of cavity 90 with the common area 86 of primary inlet passage 80. Core chutes 68, 70 are plugged with balls 76, 78 via brazing or other suitable means to prevent cooling air from entering the serpentine cooling circuit at other than desired locations.

The purge passage 98 is the sole outlet from the secondary inlet cavity 90, and the secondary inlet cavity 90 is isolated from the serpentine cooling circuit 28 except via the purge passage 98.

This arrangement also results in the formation of a pair of radial ribs 99, 100 located in the dovetail and shank portions of the bucket, adding desirable stiffness to this area of the bucket. With this arrangement, a continuous radially extending (or oriented) center rib 102 from dovetail to bucket tip is created between cooling circuit passages 104, 106. This center rib is important for overall bucket stiffness, like the center of an I-beam, and acts to carry a radial load to raise the bucket's natural frequencies.

It will further be recognized that the inlet section and horseshoe-shaped cavity creates a geometric symmetry with the serpentine inlet in the shank. This symmetry helps keep the center of mass of a bucket near the centerline of the bucket which reduces any moment imposed on the rim of the rotor wheel when spinning.

The coolant air enters the horseshoe cavity 90 from the bottom of the dovetail via passage 106 and is metered into the area of the primary inlet 80 by the elliptical passage 98. Without this purge flow, the horseshoe cavity 90 would be a dead-end cavity in which the stagnant air would become hot. This stagnant hot air would result in a thermal disparity in the shank, i.e., the forward half of the shank with the serpentine inlet would be cool and the aft half with the dead-end horseshoe cavity would be hot. This thermal mismatch would produce undesired thermally induced stresses in the shank.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising an airfoil portion, a shank portion and a dovetail mounting portion; an internal cooling circuit including inlet passages in said shank portion and said dovetail mounting portion connected to a cooling circuit in said airfoil portion, said inlet passages including a primary inlet passage on one side of a radial centerline of the bucket, and a secondary inlet cavity on an opposite side of said radial centerline; and a purge passage in said shank portion directly connecting said secondary inlet cavity to said primary inlet passage, said purge passage being the sole outlet from said secondary inlet cavity.

2. The turbine bucket of claim 1 wherein said secondary inlet cavity comprises a generally inverted horseshoe-shaped cavity.

3. The turbine bucket of claim 2 wherein said purge passage is elliptical in cross-section.

4. The turbine bucket of claim 3 wherein said purge passage has a major axis of about 0.20 inch and a minor axis of about 0.070 inch.

5. The turbine bucket of claim 4 wherein said major axis is oriented in a radial direction.

6. The turbine bucket of claim 1 and further comprising a radially oriented rib extending along said radial centerline from said shank portion into said airfoil portion.

7. The turbine bucket of claim 1 wherein each of said primary inlet passage and said secondary inlet cavity include a pair of respective passage portions merging in respective common areas radially adjacent said cooling circuit.

8. The turbine bucket of claim 7 wherein said cooling circuit comprises a plurality of substantially radially oriented passages in serpentine form.

9. The turbine bucket of claim 7 wherein radially oriented ribs extend between each pair of passage portions.

10. A turbine bucket comprising an airfoil portion; a shank portion; a mounting portion; and an internal cooling circuit that includes a serpentine cooling passage in said airfoil portion and an inlet passage configuration in said shank and said mounting portion; said inlet passage configuration comprising a primary inlet passage adjacent a leading edge side of said bucket and a secondary inlet cavity adjacent a trailing edge side of said bucket, and wherein a purge passage of elliptical cross-sectional shape located radially inwardly of said serpentine cooling passage connects said primary inlet passage directly to said secondary inlet cavity to thereby purge cooling air from said secondary inlet cavity, wherein said secondary inlet cavity is isolated from said serpentine cooling circuit except via said purge passage.

11. The turbine bucket of claim 10 wherein said secondary inlet cavity is generally of inverted horseshoe-shape.

12. The turbine bucket of claim 10 wherein said purge passage has a major axis of about 0.20 inch and a minor axis of about 0.070 inch.

13. The turbine bucket of claim 12 wherein said major axis is oriented in a radial direction.

* * * * *